US005093769A

United States Patent [19]

Luntsford

[11] Patent Number: 5,093,769

[45] Date of Patent: Mar. 3, 1992

[54] SURGICAL LIGHTING SYSTEM

[76] Inventor: K. Paul Luntsford, 6835 SW. 206th Pl., Aloha, Oreg. 97007

[21] Appl. No.: 592,645

[22] Filed: Oct. 4, 1990

[51] Int. Cl.[5] ..... F21V 21/14

[52] U.S. Cl. ..... 362/269; 362/267; 362/285; 362/293; 362/294; 362/419; 362/804

[58] Field of Search ..... 362/804, 267, 269, 271, 362/285, 293, 419, 428, 294

[56] References Cited

U.S. PATENT DOCUMENTS

| | | | |
|---|---|---|---|
| 3,225,184 | 12/1965 | Reiber . | |
| 3,287,552 | 11/1966 | Drandell . | |
| 3,459,934 | 8/1969 | Hardin, Jr. | 362/294 |
| 3,491,230 | 1/1970 | Lory . | |
| 3,702,928 | 11/1972 | Alger . | |
| 3,704,928 | 12/1972 | Coombs et al. | 362/804 |
| 3,783,263 | 1/1974 | Cruse . | |
| 3,845,351 | 10/1974 | Ballmoos et al. | 315/293 |
| 4,156,891 | 5/1979 | Roche | 362/267 |
| 4,254,454 | 3/1981 | Moore | 362/294 |
| 4,275,433 | 6/1981 | Caldwell | 362/267 |
| 4,288,844 | 8/1981 | Fisher et al. | 362/33 |
| 4,316,237 | 2/1982 | Yamada et al. | 362/33 |
| 4,380,794 | 4/1983 | Lawson | 362/804 |
| 4,463,410 | 7/1984 | Mori | 362/293 |
| 4,630,182 | 12/1986 | Morsi et al. | 362/294 |
| 4,639,838 | 1/1987 | Kato et al. | 362/804 |
| 4,651,257 | 3/1987 | Gehly | 362/293 |
| 4,701,833 | 10/1987 | Bornhorst | 362/294 |
| 4,757,426 | 7/1988 | Scheller et al. | 362/804 |
| 4,797,795 | 1/1989 | Callahan | 362/233 |

OTHER PUBLICATIONS

Strand Lighting Marketing News "Litescan", May 1, 1987, 8 pages.

Strand Lighting Taskmaster Specifications, Oct. 1987, 2 pages.

Lighting Dimensions "Buyers Guide", Jul./Aug. 1990, pp. 1, 185.

IES Lighting Handbook, 1987 Application Handbook, pp. 7-7 to 7-21.

Precision Automated Luminaire System, System Description, Oct. 2, 1989, 8 pages.

"Premiere", Beyond Imagination brochure, Strand Electro Controls, 8 pages.

Amsco "Polaris SL Large Diameter Surgical Light", 6p. brochure.

Amsco "Polaris Universal Surgical Lighting System", 6p. brochure.

Strand Lighting "Par 64 Spotlight" 4757/58, 2 page brochure.

*Primary Examiner*—Ira S. Lazarus
*Assistant Examiner*—Sue Hagarman
*Attorney, Agent, or Firm*—Klarquist, Sparkman, Campbell, Leigh & Whinston

[57] ABSTRACT

A surgical lighting system provides remote control of surgical lights. The parameters (for example, illumination levels and beam direction) of the lights are remotely controlled, thereby eliminating the need for surgical personnel to manipulate the lights. The individual light instruments that are employed with the system are enclosed in the housing that isolates the instruments from the surgical suite, thereby avoiding contamination. A sequence of lighting parameters as required for a particular surgical procedure may be pre-recorded and played back by the processor that controls the light instrument parameters.

11 Claims, 3 Drawing Sheets

SURGICAL LIGHTING SYSTEM

TECHNICAL FIELD

This invention relates to a system for illuminating a surgical suite.

BACKGROUND INFORMATION

Surgical suites must be properly illuminated so that the surgical personnel may comfortably observe the surgical procedure. The viewing comfort of the surgical personnel is enhanced when the instruments employed for illuminating the surgical suite are precisely controlled for providing intensity or brightness levels that completely illuminate the procedure without causing eye strain.

The illumination source of surgical lights should be selected so that the light reaching the particular surgical site provides correct perception of the color of the tissues that are subject to the surgical procedure. Correct color perception is important for accurate diagnosis of damaged or diseased tissue.

Surgical suite illumination requirements vary during the course of a surgical procedure. The illumination requirements vary, for example, with respect to the particular sites that must be illuminated. Moreover, it is often desirable to change the diameter of the light beams that are directed to the surgical site.

The variations in illumination requirements usually necessitate the relocation or redirection of the surgical lights. Prior surgical lights include a lamp that is housed within a large reflector body. The lights are mounted for movement in the vicinity of the surgical site or operating table. These lights are movable by hand and are, therefore, repositioned by surgical personnel.

Conventional surgical lights often interfere with surgical procedures because the lights must remain within reach of the surgical personnel. The large lights can, therefore, obstruct movement of the surgical personnel.

SUMMARY OF THE INVENTION

The present invention is directed to a surgical lighting system that provides remote control of the parameters (for example, illumination intensity levels and beam direction) of surgical lights, thereby eliminating the need for surgical personnel to manipulate the lights. Moreover, the lights are mounted at a location away from the surgical site so as not to interfere with the movement of the surgical personnel.

The light instruments that are employed with the lighting system of the present invention are enclosed within a housing that isolates the instruments from the surgical suite. Accordingly, the housing prevents surgical suite contamination from the light instrument and the associated mechanisms for moving the instrument.

The mechanisms for changing light instrument parameters are controlled by control signals from a control unit. The control unit is programmable for recording a sequence of such control signals, and for applying the recorded sequence of signals, on command, to the light instruments. Accordingly, a typical sequence of lighting parameters as required for a particular surgical procedure may be recorded in advance of the procedure and "played-back" on command, thereby minimizing the time required by surgical personnel to adjust the parameters of light instruments during the surgical procedure.

As another aspect of this invention, the light produced by the instruments is filtered to minimize infrared and ultraviolet radiation within the suite.

As another aspect of the invention emergency or reserve lights are provided. The reserve lights are activated in the event of a failure of a primary light instrument.

As another aspect of this invention, a portable control unit is provided for permitting a user to alter lighting parameters from any location within the suite.

DESCRIPTION OF A PREFERRED EMBODIMENT

Figure 1:
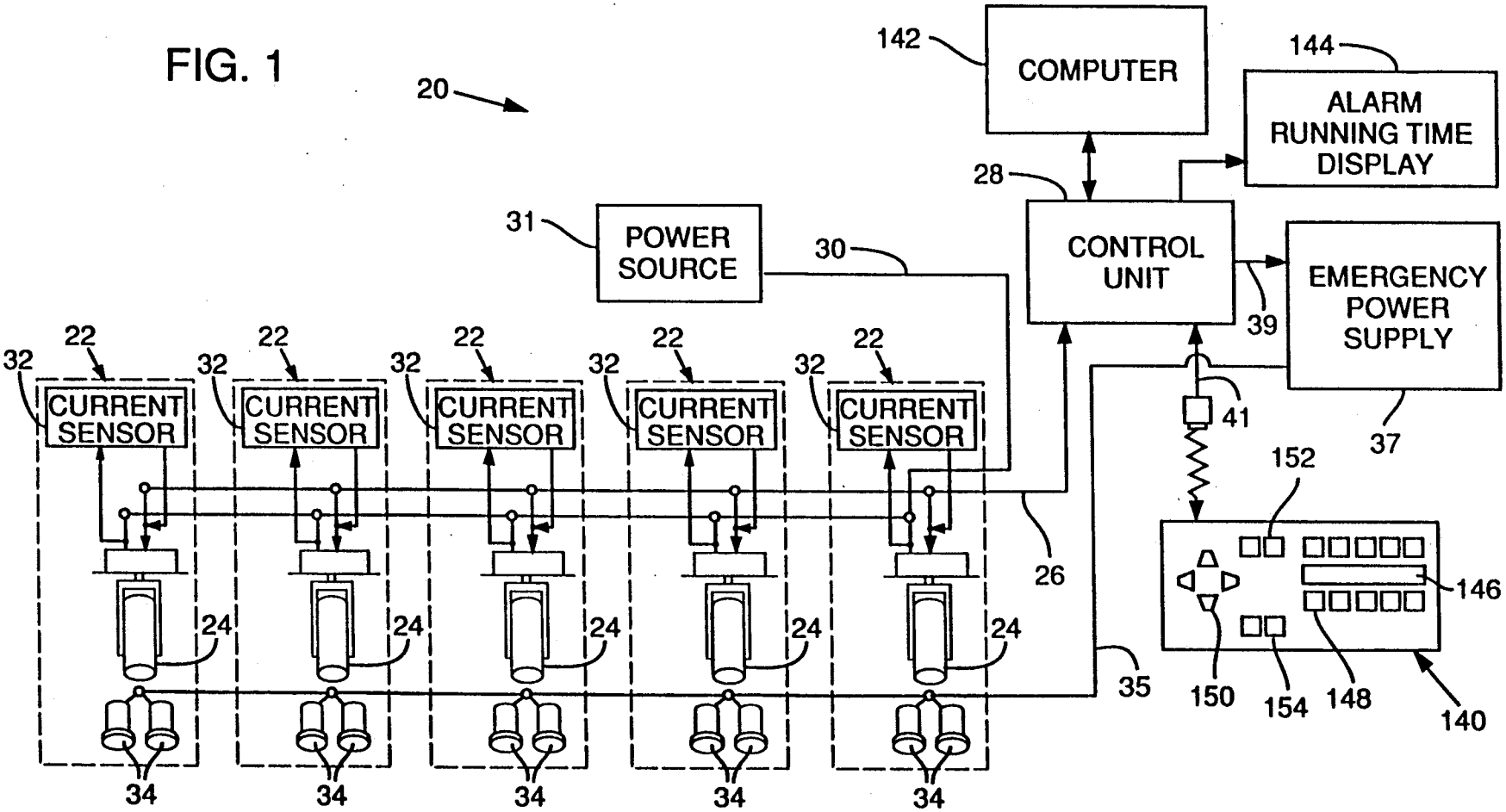
FIG. 1 is a block diagram of a lighting system of the present invention.

Referring to the diagram of FIG. 1, a surgical lighting system 20 of the present invention includes a plurality of overhead light installations 22 mounted to the ceiling of a surgical suite. Each light installation 22 includes a movable, remote-controlled primary light instrument 24. Each light instrument 24 is connected via a control bus 26 to a control unit 28 that provides control signals over bus 26 for changing the parameters (illumination intensity, beam diameter, etc.) of the individual light instrument 24, as described more fully below.

Each light instrument 24 is provided over line 30 with power from a conventional source 31. Each light installation 22 also includes a current sensor 32 that is connected to power line 30 and that provides an output signal on control bus 26 whenever the associated light instrument 24 is drawing current. Accordingly, the control unit 28 is continuously apprised, via the output of the current sensor 32, as to whether the light instrument 24 is operating.

A pair of emergency or reserve lights 34 are mounted at each installation 22 for providing backup flood lighting of the suite in the event of a power failure or a malfunction of the primary light instrument 24.

Power is provided to the reserve lights 34 via line 35 from a conventional emergency power supply 37. The emergency power supply 37 is activated by a conventional automatic transfer switch (not shown) in the event of a power failure. Alternatively, the emergency power supply 37 may be activated in response to signals generated by the control unit 28 over control line 39 whenever the control unit receives over control bus 26 an indication from current sensor 32 that one of the lights instruments 24 has failed. The particulars of the reserve lights 34 are described more fully below.

The number of installations 22 provided in a surgical suite varies with the size and lighting requirements of any particular suite. FIG. 1 shows a preferred embodiment wherein five discrete lighting installations 22 are used with a surgical suite. Preferably, one installation 22 is located immediately above the operating table (not shown), and each of the remaining four installations 22 will be located generally above a corner of the operating table so that the surgical procedure carried out on the table is illuminated from all directions.

Figure 2:
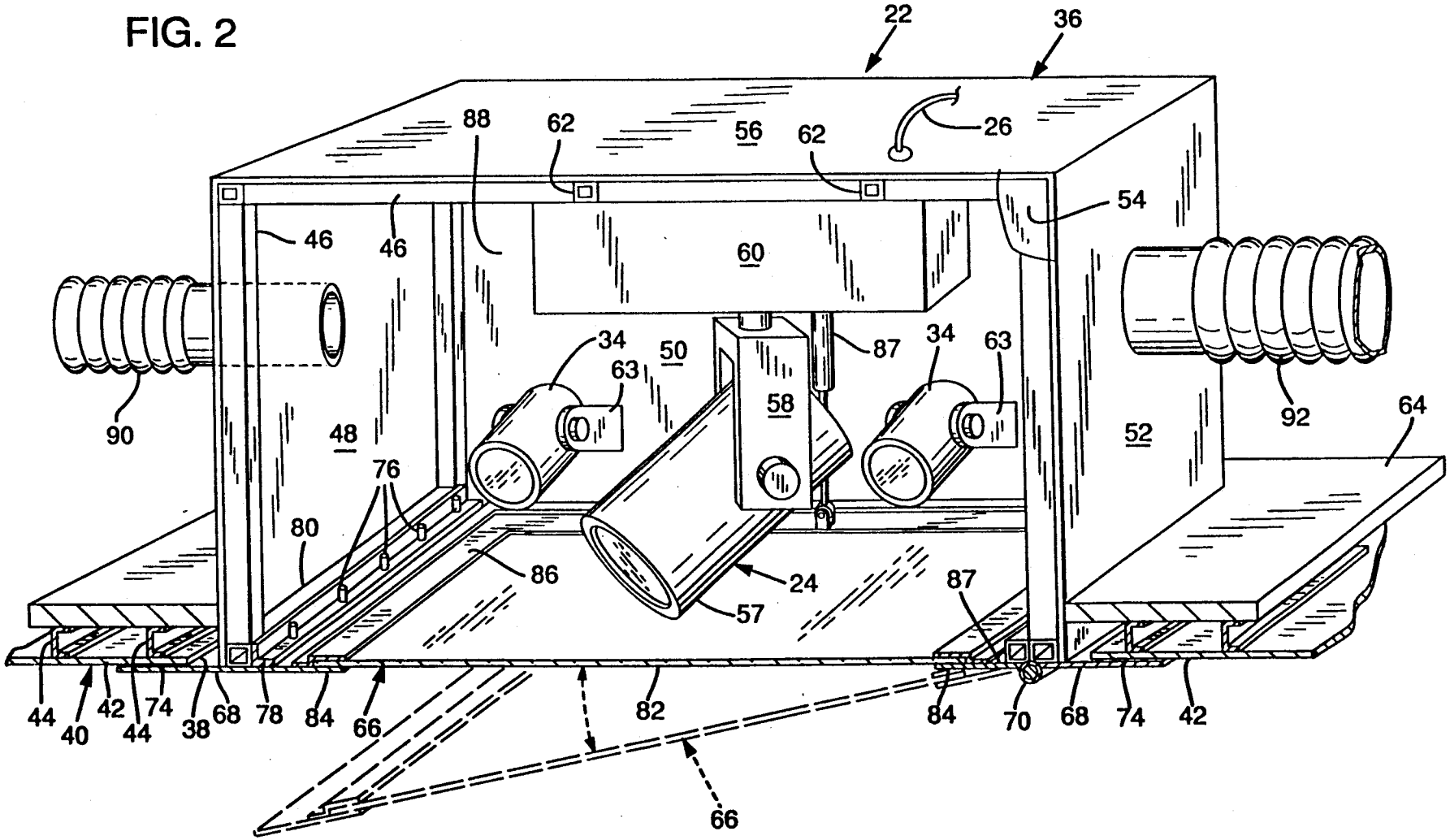
FIG. 2 is a diagram of a light instrument housing formed in accordance with the present invention.

The particulars of an individual lighting installation 22 are now described with respect to FIG. 2. The lighting installation 22 includes a box-like housing 36 that is mounted over an opening 38 formed in the ceiling structure of a surgical suite. The ceiling structure includes a rigid flat panel 42 that is carried by a number of spaced-apart support channels 44. The housing 36 also includes a rigid framework 46 formed of rigid tubular steel beams. Sheet metal is attached to the frame 46 to define solid side walls 48, 50, 52, 54, and a top wall 56.

The light instrument 24 includes a lamp 57 that is mounted to a yoke 58 that is suspended from a control box 60. The control box 60 is fastened to reinforcing cross beams 62 that form part of the housing framework 46.

The lamp 57 is mounted to the yoke 58 for pivotal movement about a horizontal axis. The yoke 58 is mounted to the control box 60 for rotational movement about a vertical axis. The yoke 58 and control box 60 include suitable drive mechanisms for controlling the horizontal pivotal motion of the lamp 57 and the vertical rotation of the yoke 58 in response to appropriate control signals received over the control bus 26. A suitable control box, yoke and lamp assembly is that manufactured by Strand Lighting, Inc., of Rancho Dominguez, Calif., Model No. 5480, as part of its Precision Automated Lighting System (PALS). It is pointed out, however, that the system just identified is modified, as described below, for the purpose of meeting the particular lighting requirements of a surgical suite.

The reserve lights 34 are mounted in the housing 36 via support brackets 63. The reserve lights 34 are mounted to the brackets 63, and the brackets 63 to the housing 36, in an orientation such that light from the reserve lights 34 will flood the operating table in the surgical suite in the event the reserve lights 34 are turned on. In the preferred embodiment, the reserve lights 34 are substantially immovable relative to the housing 36. It is contemplated that one or more reserve lights 34 may be employed in a single housing 36.

The housing 36 is supported upon the ceiling structure 40 by a rigid support plate 64 that is fastened to protrude outwardly from the side walls 48, 50, 52, 54 of the housing near the bottom of the housing 36. The support plate 64 rests upon the upper ends of the support channels 44 that are near the ceiling opening 38. The bottom 66 of the housing 36 is substantially sealed to the ceiling opening 38 to avoid contamination of the underlying surgical suite. In this regard, the bottom 66 of the housing 36 includes a rigid, flat metal frame 68 that extends beneath the four side walls 48 50, 52, 54 of the housing 36. The frame 68 is fastened to the bottom of one side wall 52, and includes a hinge 70 that extends along the bottom of the side wall. The hinge 70 permits the bottom 66 of the housing 36 to be swung downwardly (dashed lines in FIG. 2) to provide access to the interior chamber 88 of the housing 36.

The frame 68 is sized to overlap the portion of the ceiling panel 42 that is nearest the opening 38. Preferably, a compressible gasket 74 is fastened to the ceiling panel 42 between the panel 42 and the frame 68. Whenever the frame 68 is in the closed position (i.e., solid lines in FIG. 2) the gasket 74 will compress to form a substantially air-tight seal between the housing interior chamber 88 and the surgical suite.

The frame 68 is held in the closed position by a plurality of spaced-apart threaded fasteners 76, the shanks of which pass through the frame 68 and into a support angle 78. The support angle 78 is attached to a beam 80 that extends along the bottom of the side wall 48 that is opposite the side wall 52 to which the hinge 70 is attached.

The frame 68 carries a transparent glass central panel 82 for permitting propagation of light from the light instrument 24 and reserve lights 34 out of the housing and into the surgical suite. The glass panel 82 overlies the inner edge 84 of the frame 68 and is held in place by a bracket 86. The bracket 86 fits over the edges of the glass panel 82 and is fastened, as by welding, to the upper surface 87 of the frame edge 84.

Preferably, the glass panel 82 is a wire-reinforced, tempered safety glass having sufficient thickness to resist breaking in the event the light instrument 24 or a reserve light 34 explodes. Accordingly, the glass panel 82 should be at least 0.25 inches thick.

Preferably, a gas-assisted compression spring 89 is connected between the glass panel bracket 86 and the housing top wall 56 for counteracting the weight of the housing bottom 66, thereby allowing safe, slow opening of the bottom 66 whenever the fasteners 76 are loosened to provide access to the housing chamber 88.

The housing 36 is ventilated in a manner such that the pressure within the interior chamber 88 is maintained slightly below ambient air pressure. The resultant partial vacuum within the chamber 88 prevents minute particles from falling through any openings in the housing and into the surgical suite. In short, the partial vacuum established in the housing chamber 88 helps prevent contamination of the surgical suite.

The ventilation system for establishing the just-described partial vacuum comprises an inlet duct 90 that is connected to one side wall 48, and an outlet duct 92 that is connected to an opposing side wall 52. Preferably, air at ambient temperature is introduced via the inlet duct 90 and removed by the outlet duct 92. The ducts 90, 92 are connected to a ventilation source (not shown) that keeps the air pressure within the ducts (hence, within the housing chamber 88) about 0.01 pounds per square inch below ambient pressure.

The ventilation system, providing as it does cool or ambient air into the chamber 88, serves to remove heat generated by the light instrument 24 and reserve lights 34.

Figure 3:
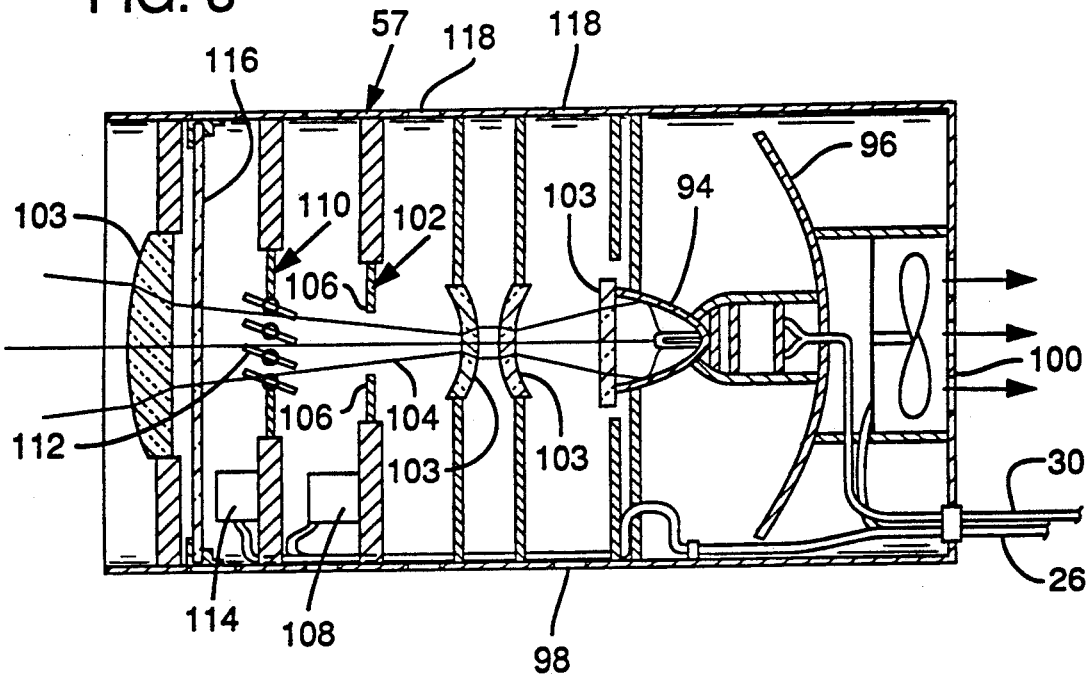
FIG. 3 is a diagrammatic cross sectional view of a light instrument used with the system of the present invention.

FIG. 3 depicts a conventional lamp 57 of a light instrument 24, as modified in accordance with the present invention. The lamp 57 is depicted without the attached yoke 58 (see FIG. 2). As mentioned above, the lamp 57 is movable for directing a light beam 104 to any selected location at or near the surgical site. The lamp 57 includes a short arc, high intensity metal halide light source 94 with associated multi-mirror reflector 96. The lamp 57 further includes a series of lenses 103 mounted for producing the narrow beam of light 104 at approximately 5,600° Kelvin color temperature.

The reflector 96 of the lamp 57 has a dichroic coating that allows some of the infrared and ultraviolet radiation generated by the source 94 to pass through the reflector 96. The heat generated by the source 94 is removed from the lamp casing 98 by a fan 100 that is mounted behind the reflector 96.

The lamp 57 also comprises a conventional iris mechanism 102 that includes shutters 106 operable for reducing or increasing the diameter of the light beam 104 that exits the lamp. The movement of the shutters 106 is controlled by a motor 108 that is operated by control signals provided by the control unit 28 over control bus 26.

The lamp 57 also includes a conventional dowser mechanism 110 that comprises a series of movable louvers 112 that are rotated by a connected motor 114. The louvers 112 serve to alter the intensity of the beam 104 leaving the lamp. The dowser mechanism motor 114 is operated by control signals produced by the control unit 28 and provided over control bus 26.

In accordance with the present invention, it is desirable to substantially eliminate the infrared and ultraviolet radiation emitted from the conventional lamp 57 just described. Consequently, the patient and surgical personnel are protected from long-term exposure to the ultraviolet radiation from the heat associated with significant amounts of infrared radiation. Accordingly, the present invention includes an auxiliary filter 116 for filtering the beam 104 to remove at least 99% of the ultraviolet radiation in the beam, without altering the color temperature of the lamp source 94. A suitable filter 116 is available from Bausch & Lomb, Inc., under the name "Optivex".

The filter 116 further includes a dichroic coating for substantially blocking propagation of infrared radiation from the lamp casing 98. The auxiliary filter 116 has the effect, therefore, of increasing the temperature within the casing 98 as a result of the infrared blocking just mentioned. A plurality of vent holes 118 are formed in the casing 98. The vent holes 118 permit the entry of cool ventilation air into the casing 98 where the air absorbs heat before being removed from the casing by the fan 100.

Figure 4:
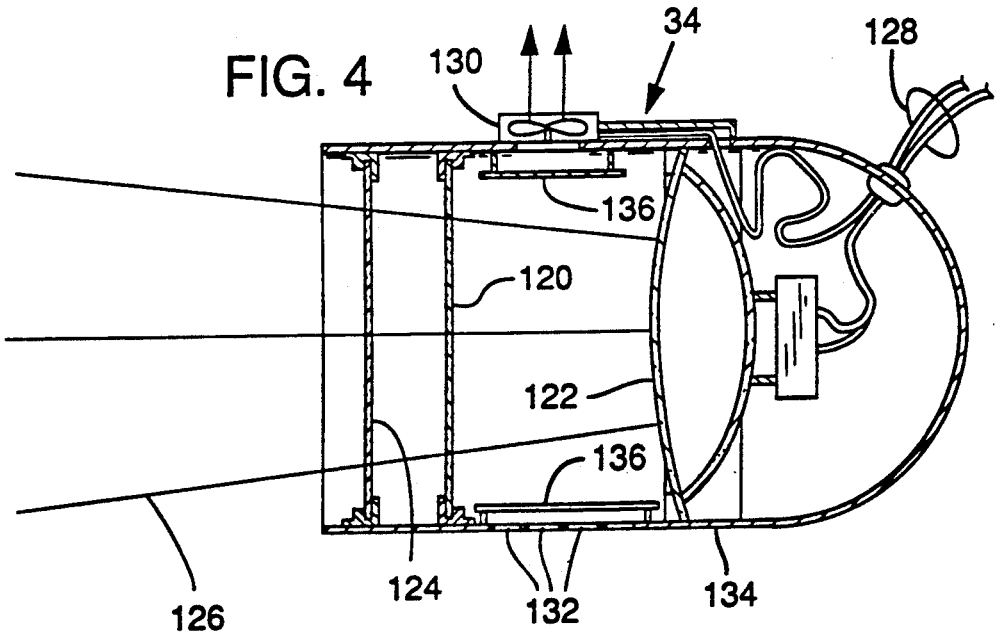
FIG. 4 is a diagrammatic cross sectional view of a reserve light used with the system of the present invention.

FIG. 4 depicts a diagrammatic cross section of a reserve light 34 in accordance with the present invention. Reserve light 34 may be a Model No. 4757, "PAR 64 CAN", as manufactured by Strand Lighting, Inc., of Rancho Dominguez, Calif., and modified as described below.

The reserve light 34 includes an infrared heat-resistant borosilicate glass filter 120 having a dichroic coating for preventing propagation of nearly all of the ultraviolet and infrared radiation from the light source 122. As noted earlier, it is desirable, in a surgical lighting application, to substantially eliminate ultraviolet and infrared radiation from the surgical suite.

The reserve light source 122, which is a tungsten-halogen type, has a relatively low (i.e., approximately 3,050° Kelvin) color temperature, which is unsuitably low for appropriate color perception for most surgical procedures. In accordance with the present invention, therefore, a second dichroic filter 124 is mounted across the path of the light beam 126 for increasing the color temperature to at least 5,500° Kelvin. As a result, the light beam 126 will provide backup emergency flood lighting that is similar, in intensity and color, to the light provided by the light instrument 24 described above.

The reserve light 34 also includes a fan 130 and associated vents 132 connected to the casing 134 of the reserve light 34. The fan 130 and vents 132 are provided for the removal of the heat that develops within the fan casing 134 as a result of the inclusion of the infrared blocking filter 124. Baffles 136 are mounted across the opening of the fan 130 and the vents 132, thereby preventing leakage of the light through those openings in the casing 134.

As noted earlier, the signals for controlling the parameters of the light instruments 24 emanate from the control unit 28. Moreover, the control unit 28 includes suitable interfacing circuitry for monitoring the output signals of the current sensor 32, for receiving input from a hereafter-described portable control unit 140, and for interacting with an associated computer 142. Such a control unit 28 is available from Strand Electro Controls, Inc., of Salt Lake City, Utah, under the trade name "Premiere", Model No. 2030.

The control unit 28 includes a digital multiplexed control and feedback system for controlling the light parameters of any particular one of the light instruments 24. To this end, the control unit is provided with operating software that is compatible with a computer 142, such as an "XT 286" (with associated monitor and keyboard) as manufactured by IBM. The computer 142 serves as a primary input/output device for allowing a user to establish the lighting parameters for all of the light instruments 24.

The preferred control unit 28 permits a user to record, in a memory device associated with the unit, a sequence of lighting parameters for the light instruments 24. The sequence of lighting parameters may correspond to those required during a particular surgical procedure. For example, a surgeon may desire a high intensity, wide diameter light beam for illuminating the abdomen of a patient while an incision is being made. After the incision, the surgeon may wish the beam diameter narrowed and the intensity increased to properly illuminate a particular organ within the patient's abdomen. Accordingly, the surgeon may record in the control unit memory the appropriate series of commands called "presets" for changing the lighting parameters in the sequence just described. The presets may be selected by the user at any time for playback. Playback means that the control unit converts the stored commands into appropriate control signals and applies those signals to the light instruments 24 over the control bus 26 as described above.

As noted, the control unit 28 receives over control bus 26 the output of each current sensor 32. In the event a current sensor output indicates that associated light instrument 24 is not drawing current (i.e., a light instrument that was previously provided with a control signal for turning on the lamp), the unit will provide a suitable alarm signal to an associated display 144 to apprise to user of the malfunctioning light-instrument(s) 24. Moreover, the emergency power supply 37 will be switched on by the control unit 28 to light the reserve lights 34 and compensate for the light lost from the failed light instrument(s) 24.

The output from each current sensor 32 is directed by the control unit 28 to a corresponding running time meter. The running time for each instrument 24 is provided on display 144 so that the user may monitor lamp life and thereby minimize the risk of lamp failure during a surgical procedure.

The present invention also incorporates a portable control unit 140, which is connected via line 41 to the primary control unit 28 and is movable within the surgical suite. The portable control unit 140 includes a multi-character display 146 for displaying information (for example, intensity levels and beam diameters of the light instruments 124) provided over line 41 by the control unit 28. The portable control unit 140 also includes: switches 148 for selecting (i.e., via the control unit 28) any particular light instrument 24; switches 150 for changing the orientation of the selected instrument 124; switches 152 for changing the beam diameter of the selected light instrument; and switches 154 for changing the intensity of the selected light instrument. Preferably, the portable control unit 140 is enclosed in material suitable for sterilization so that the unit remains within the surgical suite during the surgical procedure.

Although the invention has been shown and described in the context of a preferred embodiment, it will be apparent to those skilled in the art that changes and modifications may be made thereto without departing from the invention in its broader aspects. Accordingly, the appended claims are intended to cover all such changes and modifications as follow the spirit and scope of the invention.

I claim:

1. A lighting system, comprising:

a light instrument movable into any of a plurality of positions for illuminating any of a plurality of sites;

a housing, the light instrument being mounted within the housing and movable therein relative to the housing, the housing enclosing the light instrument and including a transparent portion through which light from the light instrument propagates;

ventilation means for moving air into and out of the housing; and remote control means for controlling movement of the light instrument by sending control signals thereto.

2. The system of claim 1 further comprising at least one reserve light mounted within the housing and operable for illuminating a site outside of the housing.

3. The system of claim 2 further comprising emergency means connected to the light instrument for sensing failure of the instrument and for operating the reserve light.

4. The system of claim 1 further comprising ventilation means for maintaining the air pressure within the housing at less than ambient pressure.

5. The system of claim 1 further comprising a metering means for monitoring and displaying the running time that the light instrument is illuminated.

6. The system of claim 1 wherein the remote control means includes programming means for storing a plurality of control signals and for sending the stored control signals to the light instrument in a preselected sequence.

7. The system of claim 1 wherein the remote control means includes a portable control unit positionable remote from the light fixture and configured for manipulation by a user at a site for changing the position of the light instrument

8. The system of claim 1 wherein the light instrument includes a source and a reflector, the reflector reflecting light from the source, the instrument including filtering means for reducing ultraviolet and infrared radiation reflected by the reflector the filtering means including an ultraviolet radiation filter mounted to the instrument to filter ultraviolet radiation reflected by the reflector.

9. A method of illuminating a surgical suite, comprising the steps of:

mounting above the surgical suite in a chamber that is sealed from the suite a light instrument that is operable by control signals for movement into any of a plurality of positions for illuminating any of a plurality of sites with any of a plurality of illumination parameters;

ventilating the chamber by moving air therethrough; and sending from a remote location to the light instrument control signals for operating the instrument.

10. The method of claim 9 wherein the ventilating step includes the step of maintaining within the chamber air pressure less than ambient air pressure.

11. The method of claim 9 further comprising the step of storing a plurality of control signals representative of preselected light instrument positions and parameters; and sending the stored control signals in a predetermined sequence.

* * * * *